US011387597B2

(12) United States Patent
Graziano et al.

(10) Patent No.: US 11,387,597 B2
(45) Date of Patent: Jul. 12, 2022

(54) CONNECTOR DEVICE

(71) Applicants: TE Connectivity Italia Distribution S.r.l., Collegno (IT); TE Connectivity Italia S.r.l., Collegno (IT)

(72) Inventors: Daniela Graziano, Turin (IT); Federico Lupo, Turin (IT); Federico Virdia, Trento (IT); Riccardo Francesco Robone, Turin (IT); Alessandro Lamacchia, Alpignano (IT)

(73) Assignees: TE Connectivity Italia S.R.L., Turin (IT); TE Connectivity Italia Distribution S.R.L., Turin (IT)

( * ) Notice: Subject to any disclaimer, the term of this patent is extended or adjusted under 35 U.S.C. 154(b) by 0 days.

(21) Appl. No.: 16/838,559

(22) Filed: Apr. 2, 2020

(65) Prior Publication Data

US 2020/0321724 A1 Oct. 8, 2020

(30) Foreign Application Priority Data

Apr. 2, 2019 (IT) ..... 102019000004893

(51) Int. Cl.
*H01R 13/527* (2006.01)
*H01R 13/506* (2006.01)
*H01R 13/627* (2006.01)

(52) U.S. Cl.
CPC ..... *H01R 13/527* (2013.01); *H01R 13/506* (2013.01); *H01R 13/6273* (2013.01)

(58) Field of Classification Search
CPC .... H01R 13/527; H01R 13/52; H01R 13/516; H01R 13/5213; H01R 13/506; H01R 13/6273
USPC ..... 439/485, 933
See application file for complete search history.

(56) References Cited

U.S. PATENT DOCUMENTS 6,918,782 B2 * 7/2005 Foster ..... H01R 13/6272 439/301
6,918,872 B2 * 7/2005 Yokoi ..... A61B 1/00036 600/129
7,121,847 B1 10/2006 Jetton
8,057,261 B1 11/2011 DeSio et al.
9,692,163 B1 6/2017 Didonato et al.
10,804,646 B2 * 10/2020 Wagner ..... H02G 3/088
2003/0012669 A1 * 1/2003 Kawashima ..... H01R 13/5213 417/423.1
2007/0093102 A1 4/2007 Park
(Continued)

FOREIGN PATENT DOCUMENTS

DE 102016221063 A1 4/2018

OTHER PUBLICATIONS

Italian Search Report, App No. 102019000004893, dated Dec. 18, 2019, 8 pages.

(Continued)

*Primary Examiner* — Gary F Paumen
(74) *Attorney, Agent, or Firm* — Barley Snyder

(57) ABSTRACT

A connector component for a connector includes a plate and a pair of fastening devices freely protruding from the plate and securing the plate to a connector housing. The plate and the fastening devices are made of a metal or plastic material having a higher inflammability resistance than the connector housing and are adapted to extend on more than one of a plurality of external surfaces of the connector housing.

19 Claims, 7 Drawing Sheets

(56) References Cited

U.S. PATENT DOCUMENTS

| | | | | |
|---|---|---|---|---|
| 2008/0003871 | A1 | 1/2008 | Feng et al. | |
| 2019/0393642 | A1 | 12/2019 | Wagner et al. | |
| 2020/0091656 | A1* | 3/2020 | Lee | H01R 13/502 |

OTHER PUBLICATIONS

Extended European Search Report, Appln. No. 20166608.8-1201, dated Aug. 24, 2020, 8 pp.
European Patent Office Communication, Application No. 20166608.8-1201, dated Jan. 12, 2022, 6 pages.

* cited by examiner

CONNECTOR DEVICE

CROSS-REFERENCE TO RELATED APPLICATION

This application claims the benefit of the filing date under 35 U.S.C. § 119(a)-(d) of Italian Patent Application No. 102019000004893, filed on Apr. 2, 2019.

FIELD OF THE INVENTION

The present invention relates to a connector and, more particularly, to a component of a connector preventing heat dissipation or flame propagation from reaching affected areas of the connector.

BACKGROUND

'Raster Anschluss Steck Technik' (RAST) is a modularized connector system widely used in home appliances. RAST connectors are based on regular pitch connection plug technology and are used, next to household appliances, also in automobiles and industrial control systems for electrical connection between electronic components such as wires and circuit boards. Due to the increase of the functions of household electrical appliances, the number of connectors for connecting function modules to the main controller is correspondingly increasing. The standardized and modularized RAST connector system may be integrated with multiple single devices and a plurality of connectors, optimizing installation time and minimizing the risks of errors while minimizing the space occupied on the PCB and the manufacturing costs.

In the appliance global market, RAST and other types of connectors must fulfill specific requirements and pass specific tests which simulate the working conditions within a house appliance. In particular, in order to get the approval of RAST or other types of connector products by the global appliance customers, the nichrome wire test on flammability must be fulfilled. Heat and flames generated inside a connector should not spread from the connector area into the surrounding parts. The nichrome wire test was introduced in the UL standard for different household appliances. Examples of these standards are: UL 749[1] for dishwashers, UL 2157[2] for electric clothes washing machines and extractors and UL 2158[3] for electric clothes dryers. The result of the nichrome wire test depends from multiple factors, which make it a complex test. It is closely related to the geometry and the type of plastic material used for the connector, for the counterpart and for the surrounding parts, the orientation of the connector inside the household appliance and the distance of the surrounding parts above the connector part.

U.S. Pat. No. 8,057,261 discloses a connector with a housing adapted to receive a flag terminal. The connector comprises an L-shaped housing into which the flag terminal can be inserted. The connector is partially insulated by the housing and has a rear opening for inserting the flag terminal. In order to comply with the proposed standards for consumer appliances, the connector has to be fully insulated in order to avoid accidental contact with exposed terminals. Thus, a rear cover is provided that can be mechanically pushed into the rear opening. The rear cover features tabs that are latched onto the respective apertures of the housing. The housing and cover are composed of an electrical insulating plastic, such as nylon. In order to reduce the risk of flame propagation or heat dissipation to the surrounding area, the housing and cover can be composed of flame retardant nylon compound.

A disadvantage of this system is that the cover is an additional part which must be installed by mechanically pushing it into the terminal opening. Also, as the shape of the cavity and the capture mechanism employed can differ for different flag terminals, the shape of the cover must be adapted so that each cover has a design specific to each flag terminal. Additionally, the cover is installed by pushing it into the terminal, meaning that the choice of the material is limited as the material chosen for the cover must be mechanically compatible with the material of the housing. Also, the main function of this cover is to isolate the electric wires, but not the terminal, therefore the flame-retardant features will be relevant only for a limited portion of the connector. Finally, this system has the disadvantage of being intended to be installed by a machine only.

U.S. Pat. No. 9,692,163 discloses a connector including a housing with a rear opening for inserting a terminal into the housing. The housing features tabs enabling a rear cover to be latched onto the housing closing the rear opening. The cover contains a plurality of retaining arms for receiving the tabs. The cover is fitted externally onto the housing and closes the housing after insertion of the terminal. The housing comprises a material that provides the housing with electrically insulating properties. This system does not address the main need of fulfilling the flammability test as the major surface of the terminal is not protected by the cover. Also, this system has a quite complex geometry and construction.

SUMMARY

A connector component for a connector includes a plate and a pair of fastening devices freely protruding from the plate and securing the plate to a connector housing. The plate and the fastening devices are made of a metal or plastic material having a higher inflammability resistance than the connector housing and are adapted to extend on more than one of a plurality of external surfaces of the connector housing.

BRIEF DESCRIPTION OF THE DRAWINGS

The invention will now be described by way of example with reference to the accompanying Figures, of which.

DETAILED DESCRIPTION OF THE EMBODIMENT(S)

The present invention will now be more fully described hereinafter with reference to the accompanying drawings, in which exemplary embodiments of the invention are shown. The present invention may, however, be embodied in many different forms and should not be construed as limited to the embodiments set forth herein. Rather, these embodiments are provided so that the disclosure will convey the scope of the invention to those skilled in the art.

In particular, although certain features of the exemplary embodiments below will be described using terms such as "top", "bottom", "front", "rear" and "side", these terms are used for the sole purpose of facilitating the description of the respective features and their relative orientation and should not be construed as limiting the claimed invention or any of its components to a use in a particular spatial orientation. Like numbers refer to like elements throughout the description.

Figure 1:
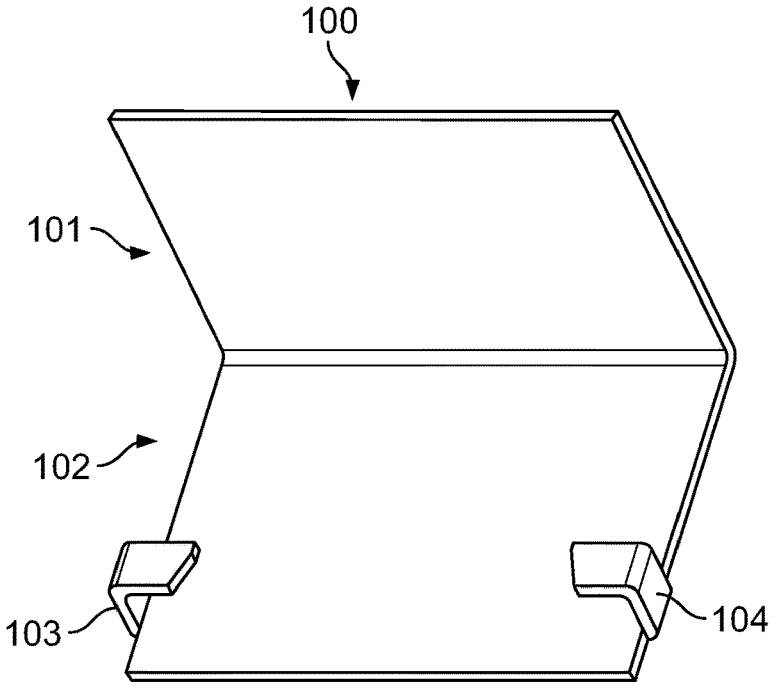
FIG. 1 is a perspective view of a connector component according to an embodiment.

A connector component 100, as shown in FIG. 1, includes a pair of plates 101, 102 joined perpendicularly to each other and fastening devices 103 and 104. The connector component 100 may also be referred to as a cover throughout the specification.

The two plates 101, 102, as shown in FIG. 1, have a rectangular or squared shape and may have the same dimension or different dimensions to be adapted to different connector geometries. The plates 101, 102 can be referred to as a first plate 101 and a second plate 102. In an embodiment, the second plate 102 is bigger than the first plate 101. In the shown embodiment, the plates 101, 102 are joined perpendicularly to each other in an L-shape.

The fastening devices 103 and 104, as shown in FIG. 1, are L-shaped elements freely protruding out of the plate 102 and having only one extremity connected to the plate 102. As used herein in the description, the term "freely" is intended to mean that the element extends in a cantilevered manner and has a free end. The fastening devices 103 and 104 are positioned at the end of the plate 102 and are oriented toward the inside of the plate 102. A first part of each of the L-shaped fastening devices 103, 104 is oriented in a direction perpendicular to the second plate 102 and a second part of each of the L-shaped fastening devices 103, 104 is oriented toward an inside of the second plate 102.

Figure 2:
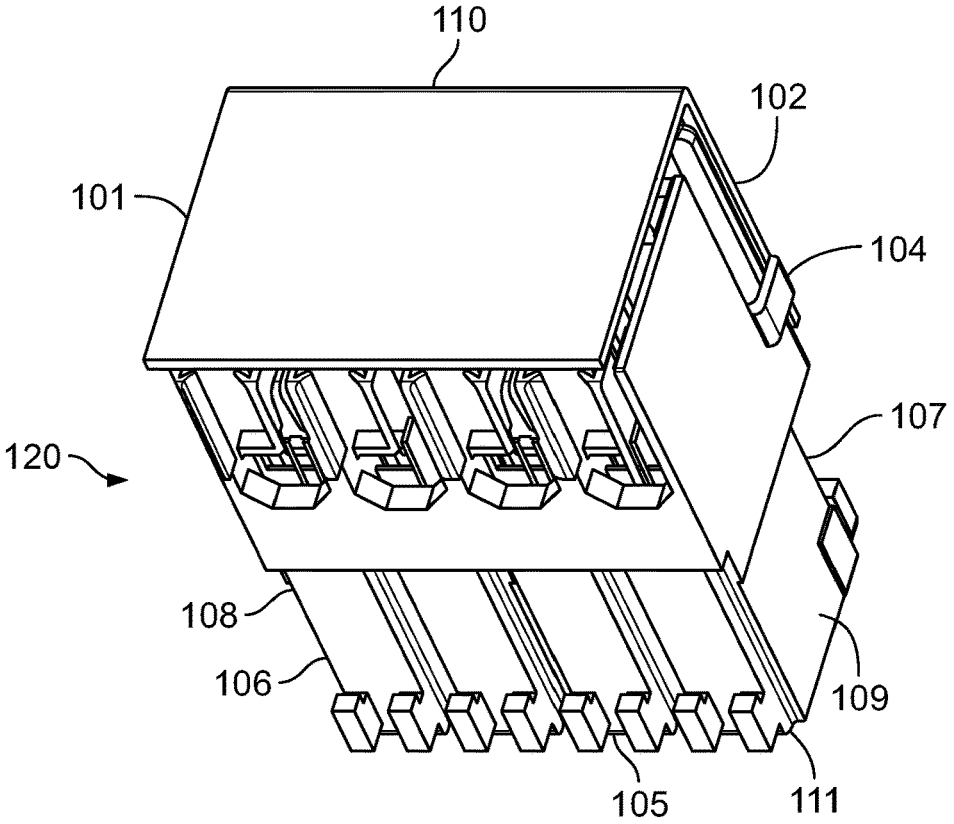
FIG. 2 is a perspective view of a connector product with the connector component of FIG. 1.
Figure 3:
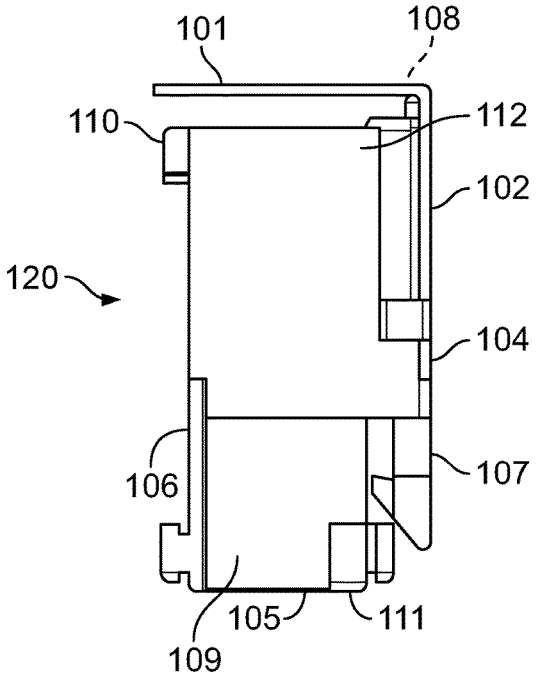
FIG. 3 is a side view of the connector product of FIG. 2.

FIGS. 2 and 3 show a connector product 120 including a connector housing 105 combined with the connector component 100 of FIG. 1. The connector housing 105 in the shown embodiment is a RAST type of connector, known as 'AMP multifitting mark II', however also other types of connectors, with different shapes and features, can be combined with the connector component 100 of FIG. 1 in the connector product 120 in other embodiments.

As shown in FIGS. 2 and 3, the component or cover 100 is externally fastened to the connector housing 105, in particular, it is reversibly inserted on the connector housing 105 by sliding the fastening devices 103, 104 inside the two slots 112 on the side of the connector housing 105, which are configured to mechanically engage with the fastening devices 103, 104. As shown in FIG. 3, the plate 102 of the connector component 100 will be directly in contact with the a rear surface 107 of the connector housing 105, while the plate 101, positioned on top of the connector housing 105, will be separated from a top surface 110 by a gap. Alternatively, there could be a gap between the rear surface 107 and the plate 102. The other connector housing 105 surfaces, i.e. the side surfaces 108 and 109, and a front surface 106, perpendicular to the side surfaces 108, 109, and a bottom surface 111 are not covered. This should be considered only as one possible configuration. Another configuration foreseen that at least one of the plates 101, 102, is bigger than the surface of the connector housing 105 that will be covered. Alternatively, instead than having two plates 101, 102, the connector component or cover 100 can also have only one plate, or more than two plates 101, 102. In an embodiment, the external surfaces 106-110 of the connector housing 105 are adapted to engage fastening devices.

In an embodiment, the connector product 120 includes the connector housing 105, a cavity for receiving an electric wire, an insertion slot perpendicular to the wire receiving cavity for receiving a metallic contact, and the connector component 100. In an embodiment, the connector is a power connector. A method of assembling the connector includes the steps: molding the connector housing 105; inserting the metallic contact and inserting the electric wire; and latching the connector component 100 on the connector housing 105 before or after inserting the metallic contact, or before or after inserting the electric wire. The connector component 100 is latched on the connector housing 105 during the appliance assembly.

In another embodiment, a household appliance includes the connector component 100.

During the flammability test on the connector, the area of the connector which is most affected by the heat is identified. The test is performed as described in the UL standard. For example, samples may be subjected to a test current of 11 Amp for 20 minutes induced by an energized nichrome wire coil. A condition of overheating is generated, which will cause melting of the connector housing 105.

The test allows verification that the thermal stresses that will act on the connector within a house appliance are not homogeneously distributed, some portions will be subjected to higher stress, some to lower. For this reason, only some portions, as for example in this case the rear surface 107 and the top surface 110 of the connector housing 105, require shielding from the surrounding by the connector component or cover 100, while some others, like 106, 108, 109, 111, do not need to be shielded. The connector component 100, is made by a material with higher flammability resistance than the connector itself. For example, looking at the component 100 in FIGS. 3-4 the top surface 110 and the rear surface 107 of the connector housing 104 melted under test conditions and thus require to be covered with the component 100 when mounted within a house appliance. The component 100 prevents heat dissipation or flame propagation from affected areas of the connector housing 105.

The cover, or the flame retardant cover 100, can be made of high thermal resistance polymers, such as polyphenylenesulfide. Other suitable materials are polyamide, or polybutylene terephthalate or polyethylene terephthalate and polycarbonate or any other plastic materials that can prevent heat and flames from spreading from the connector area to the surrounding parts within the appliances. In an embodiment, the connector component 100 is made of a material having a higher inflammability resistance than a material of the connector housing 105. Also other forms can be used, such as liquid crystal polymers. Alternatively metals can also be used. In an embodiment, the connector component or cover 100 can be made of different materials with different chemical-physical properties and thermal resistances.

Figure 4:
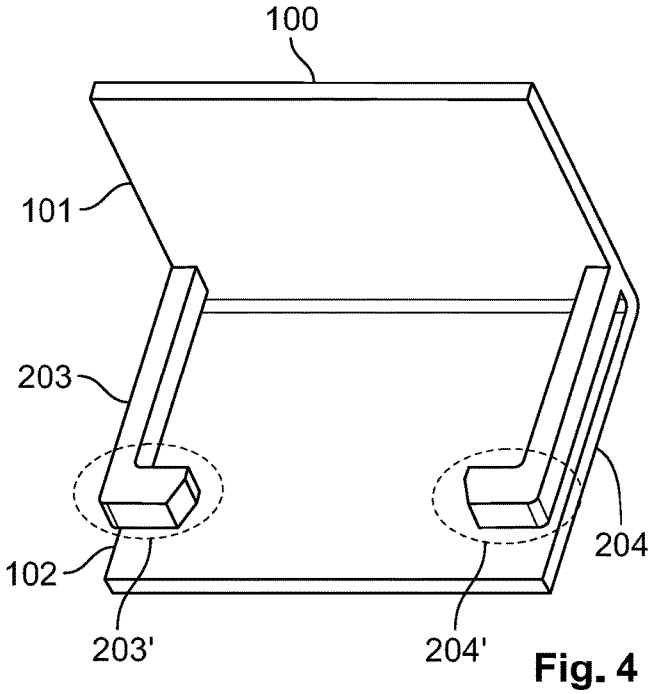
FIG. 4 is perspective view of a connector component according to another embodiment.

FIG. 4 shows a different type of connector component or cover 100 geometry, in which the two plates 101 and 102 are joined perpendicularly to each other and the fastening devices or side latches 203 and 204 are connected to the first plate 101 by one of their extremities and extend from the first plate 101 along the sides of the second plate 102. The fastening devices or side latches 203, 204 include at their ends hooking portions 203' and 204' projecting toward the inside part of the second plate 102. Alternatively, instead then having two plates 101, 102, the connector component or cover 100 of the embodiment of FIG. 4 can also have only one plate (image not shown). In other embodiment, the fastening devices 203, 204 are not necessarily latches, but could be any other kind of gripping device.

Figure 5:
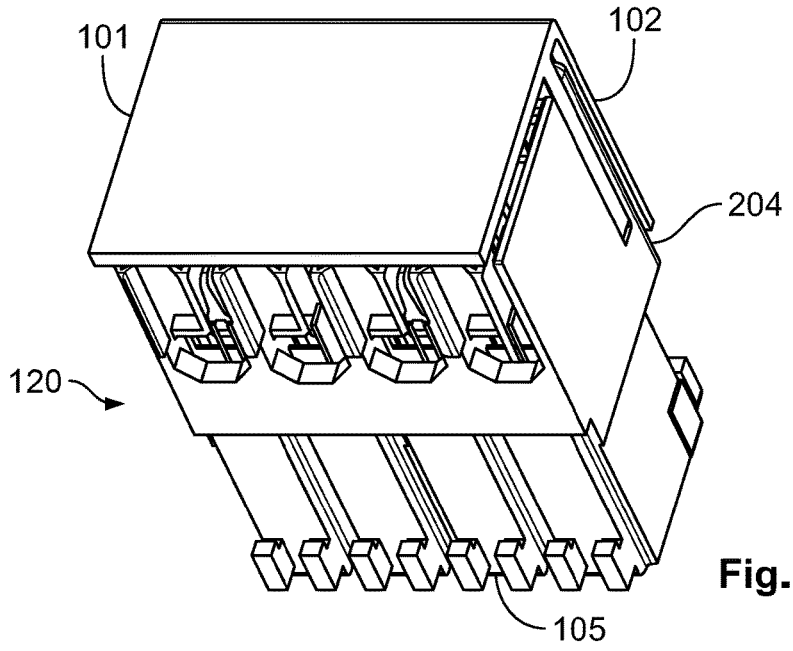
FIG. 5 is a perspective view of a connector product with the connector component of FIG. 4.
Figure 6:
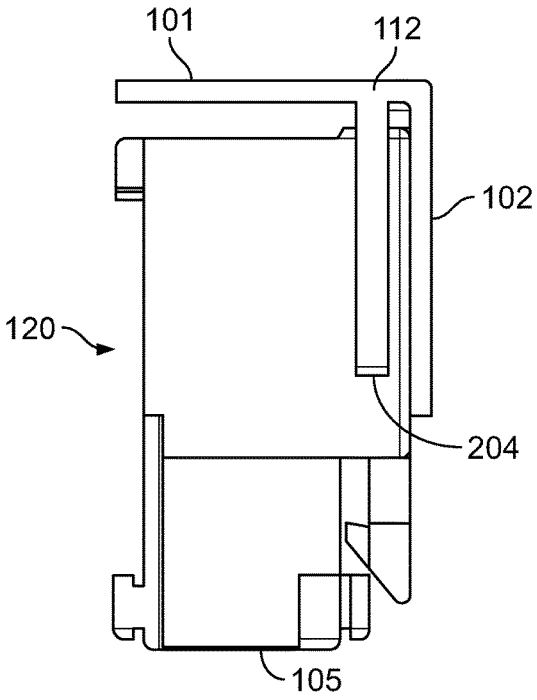
FIG. 6 is a side view of the connector product of FIG. 5.

FIGS. 5 and 6 show the connector product 120 including a connector housing 105 of the kind of that described above for FIG. 2 and FIG. 3, and the connector component 100 of FIG. 4 in two different perspectives. The connector component or cover 100 can be slid over the connector housing 105 and be positioned where the protection with high thermal resistance material is needed. The fastening devices or side latches 203 and 204 will at the moment of insertion through the slits 112 be forced to temporarily deform towards the outside, and as soon as the cover 100 is in the final position, the terminal parts or end hooking portions of the fastening devices or side latches 203' and 204' will mechanically engage the housing 105.

Figure 7:
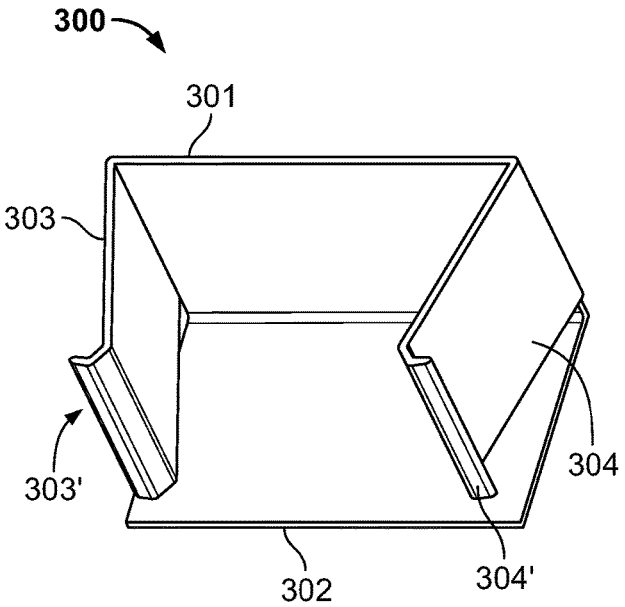
FIG. 7 is a perspective view of a connector component according to another embodiment.
Figure 8:
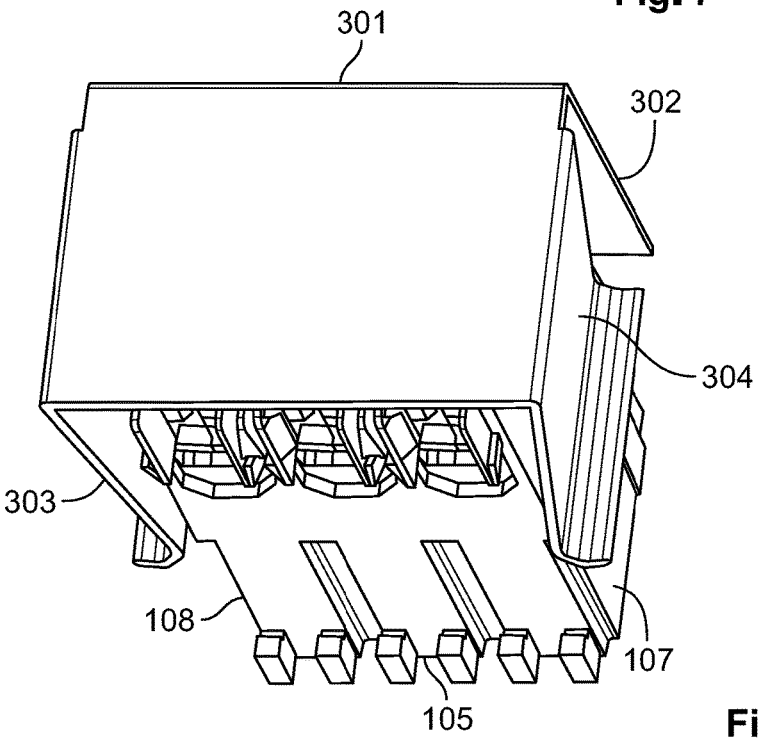
FIG. 8 is a perspective view of a connector product with the connector component of FIG. 7.
Figure 9:
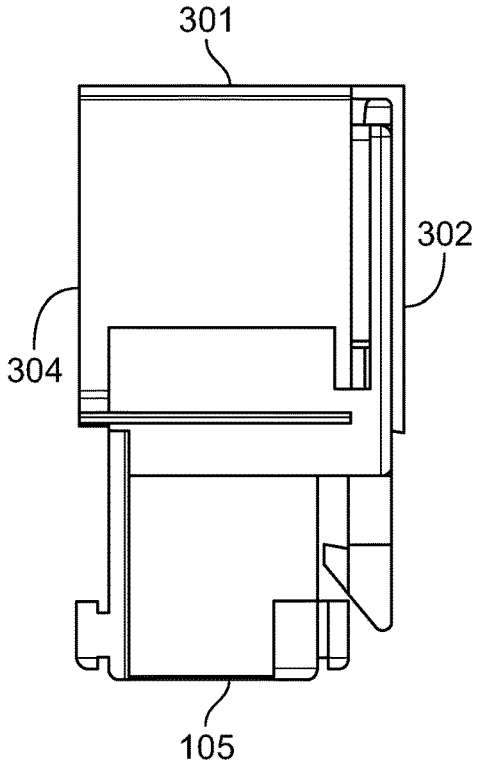
FIG. 9 is a side view of the connector product of FIG. 8.

If a higher surface needs to be covered, the cover 300 of FIG. 7 could be used. The plates 301 and 302 of the cover 300 have a similar configuration as that of the other connector components 100, but the fastening devices or side latches 303 and 304 are fastening plates having rectangular shapes freely extending out of the plate 301 and tilted at a certain angle towards the inside of the second plate 302. The fastening devices or side latches 303 and 304 have their ends 303' and 304' tilted towards the outside of the second plate 302 to form rounded hooking portions extending along the length of the fastening devices or side latches 303, 304. This kind of connector component 300 can be used to assure partial coverage of the side surfaces 108 and 109 of the connector as represented in FIGS. 8 and 9. The component 300 is inserted with a different mechanism, i.e. it is inserted from the top and the side latched will exercise a pressure on the side surfaces 303 and 304 which will help keeping the cover in place on the housing 105. The materials used in the embodiment shown in FIGS. 7-9 are the same as described above.

Figure 10:
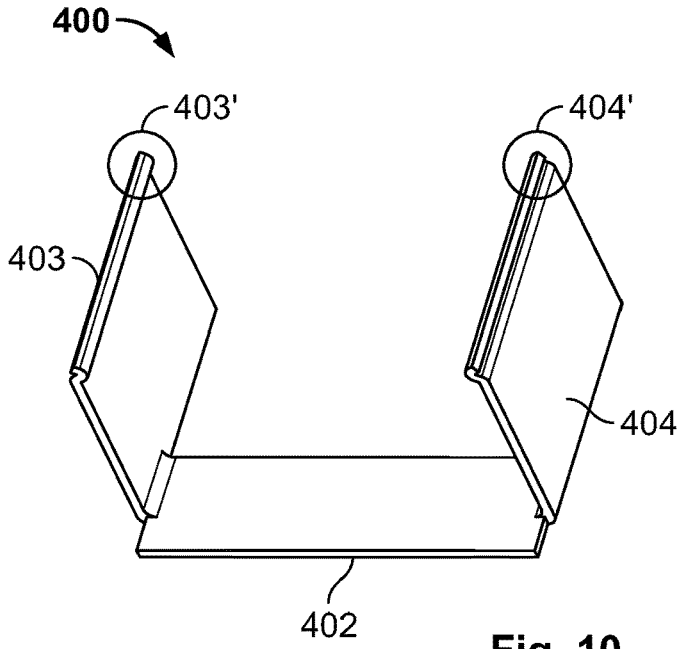
FIG. 10 is a perspective view of a connector component according to another embodiment.
Figure 11:
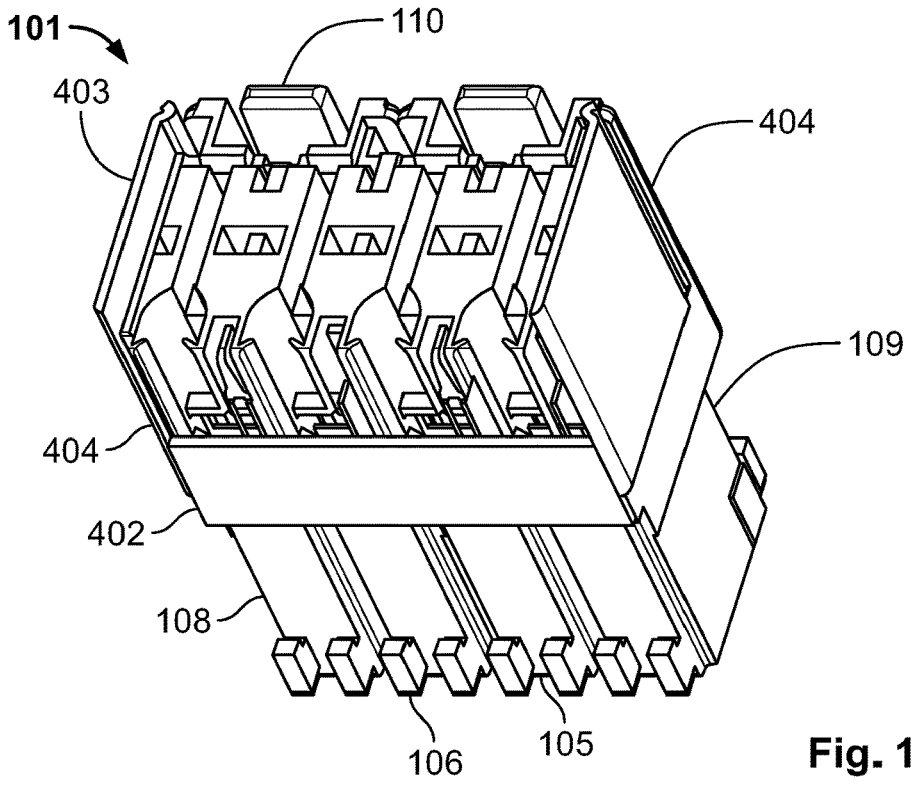
FIG. 11 is a perspective view of a connector product with the connector component of FIG. 10.
Figure 12:
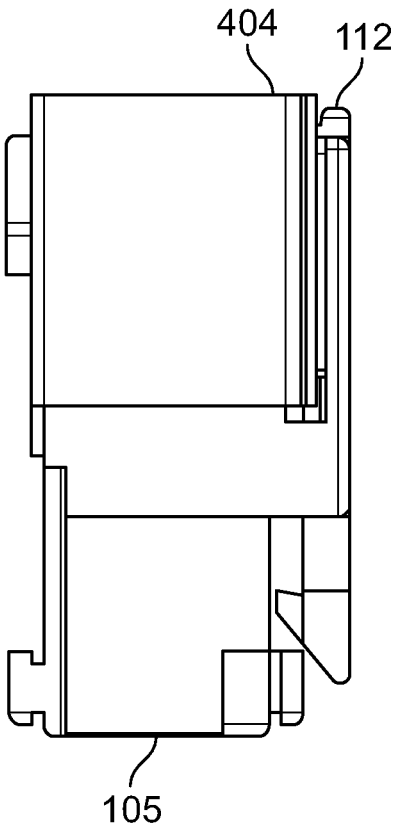
FIG. 12 is a side view of the connector product of FIG. 11.

For situations in which the top surface 110 of the connector does not need a cover, while the sides 108 and 109 can be protected, the cover or component 400 of FIG. 10 can be used. This cover 400 includes one plate 402 only and two side plates 403 and 404 as latching elements which are extending from at least part of the edges of the plate 402. The latching elements comprise end portions 403' and 404' which have a U-shape. When positioned on the connector housing 105, as shown in FIGS. 11 and 12, the front surface 106 will be covered in part, and the side surfaces 108 and 109 will be protected by the fastening devices or side latches 403, 404. The cover 400 will be slid in from the top of the connector housing 105 through the slits 112 and the fastening devices or latches 403, 404 will be locked within the slits 112 by the U-shaped end portions 403' and 404' extending along the all length of the slits 112. In the embodiment shown in FIG. 10, the side plates 403, 404 are larger than the one plate 402

Figure 13:
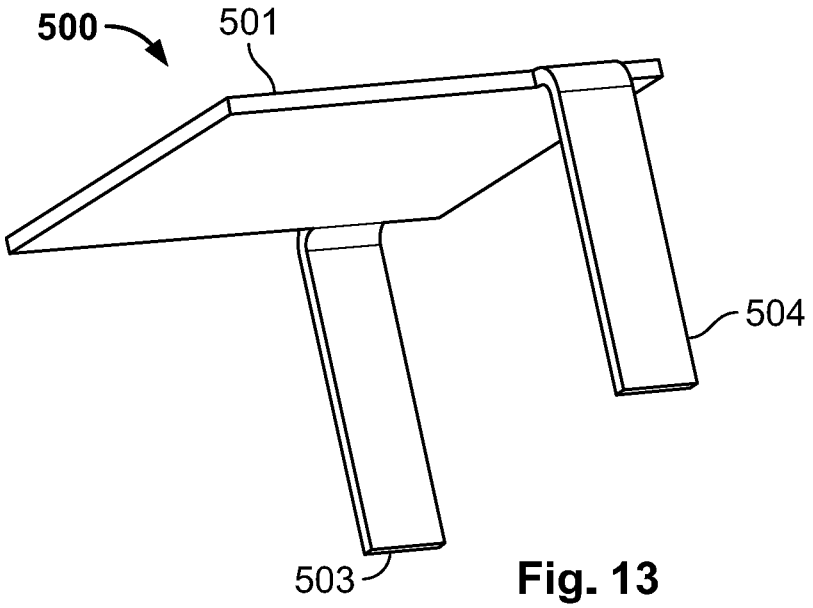
FIG. 13 is a perspective view of a connector component according to another embodiment.

A further possible configuration is shown in FIG. 13 showing the connector component or cover 500 with only one plate 501 and two strips 503 and 504 extending out of the one plate 501 functioning as fastening devices. The component will be connected to the connector housing 105 by co-molding or mechanically. In the embodiment shown in FIG. 13, the strips 503, 504 are smaller than the one plate 501.

Figure 14:
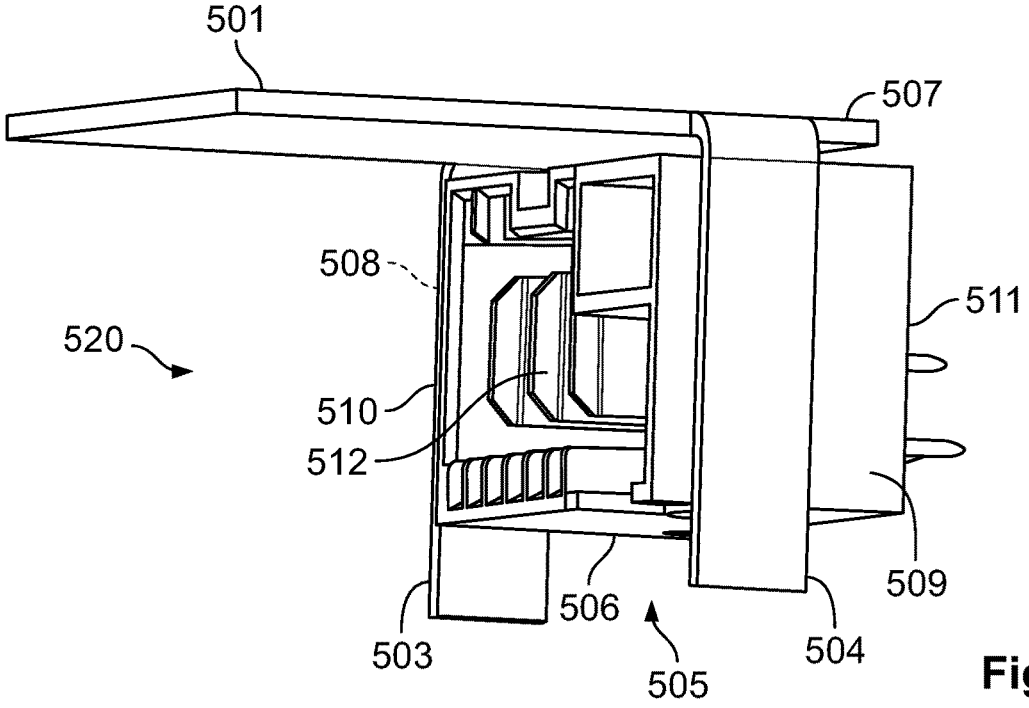
FIG. 14 is a perspective view of a connector product with the connector component of FIG. 13.
Figure 15:
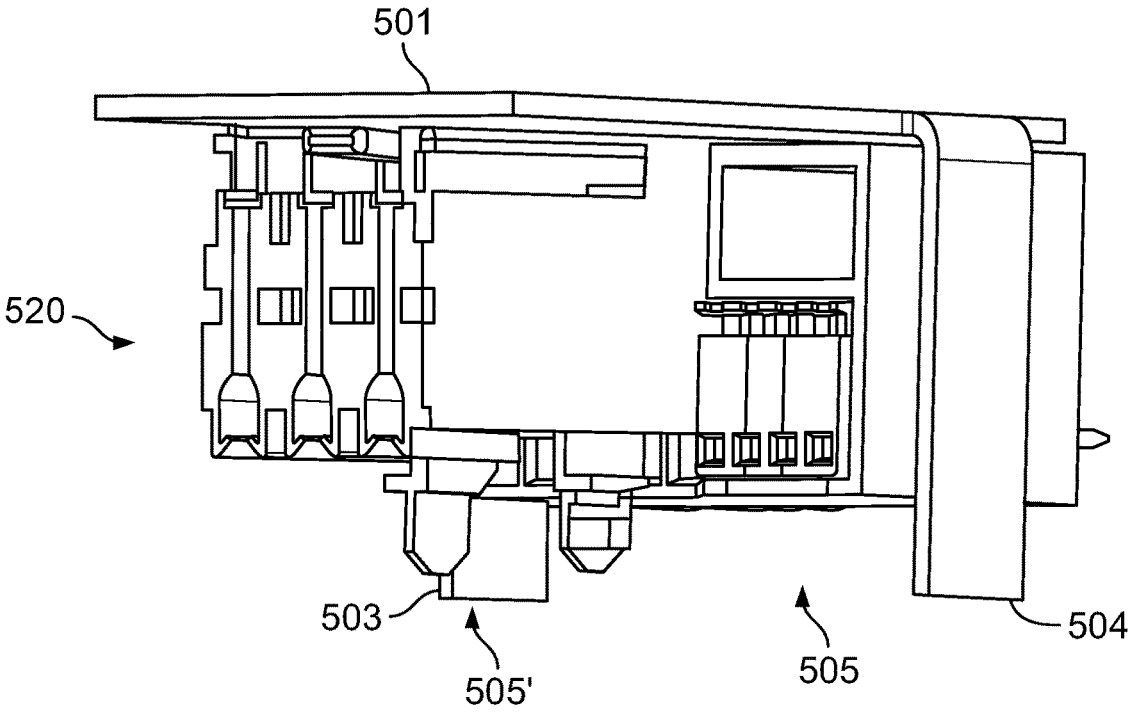
FIG. 15 is a perspective view of the connector product of FIG. 14 with a housing of the connector product connected to a counterpart.
Figure 16:
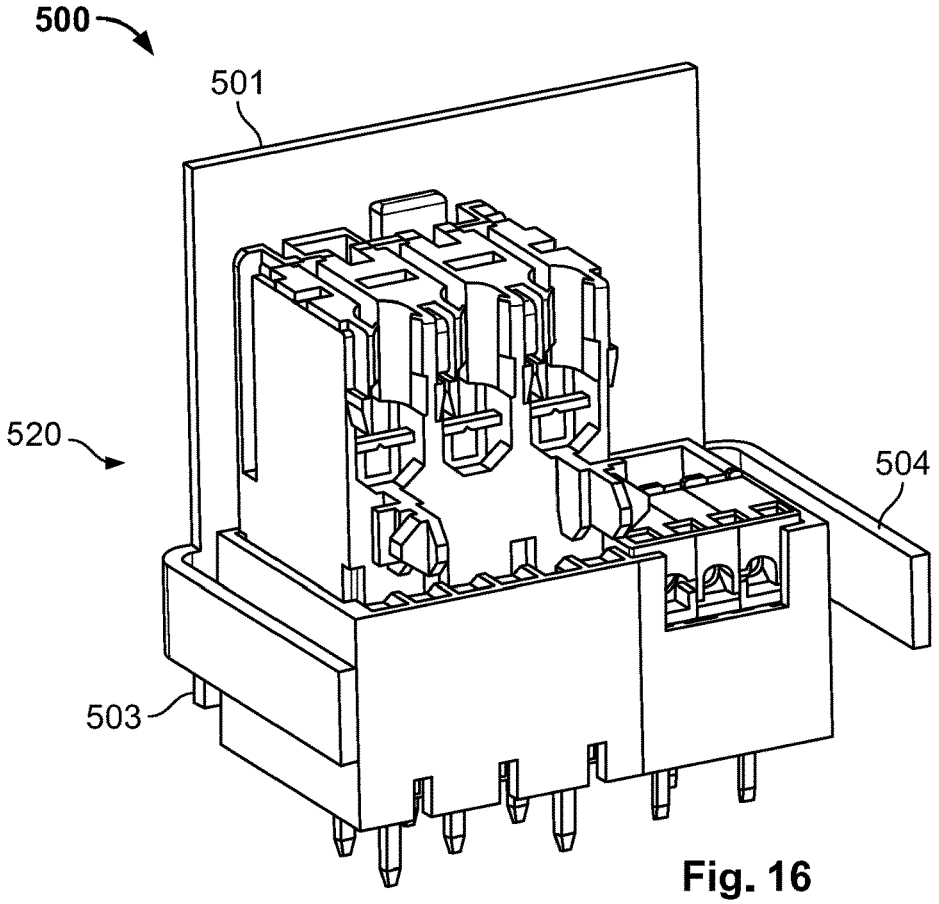
FIG. 16 is another perspective view of the connector product of FIG. 15.
Figure 17:
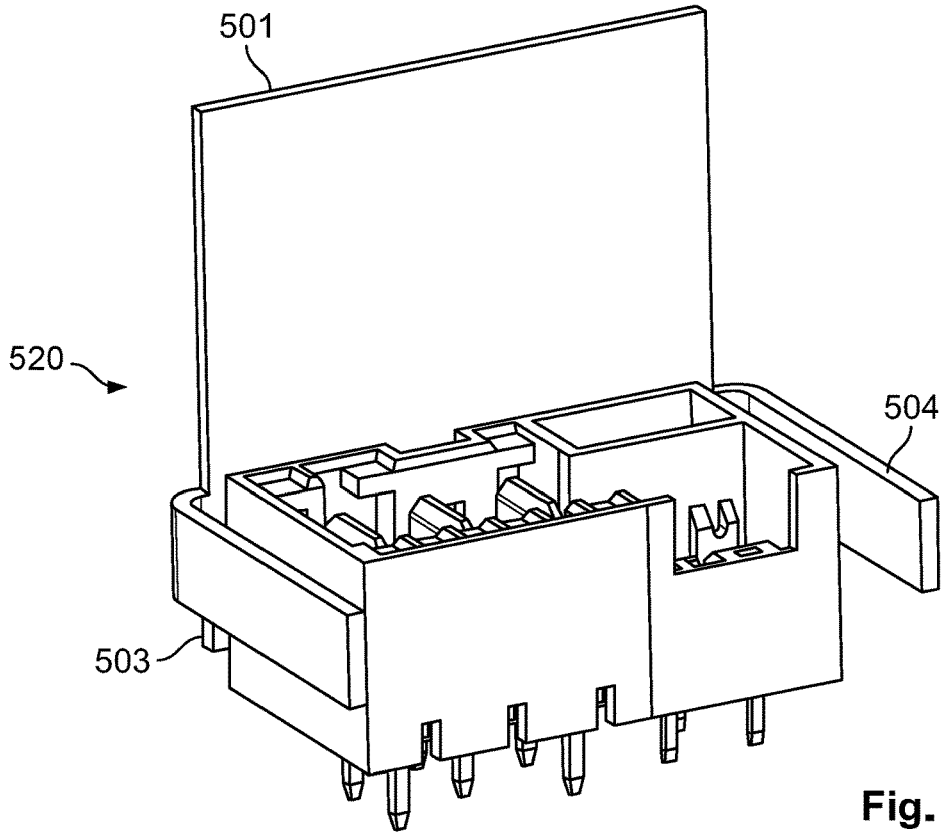
FIG. 17 is another perspective view of the connector product of FIG. 14.

FIGS. 14-17 are perspective views of a connector product 520 including the connector component 500 of FIG. 13, the housing 505, and terminals 512. In FIGS. 14 and 17, the counterpart of the housing 505 shown in the other examples is represented, while in FIG. 15 and FIG. 16 the housing 505 and its counterpart are combined. The connector product 520 can cover also the final assembly of a product. The connector component 500 can be mated on the connector housing 505 itself during connection termination (insertion electric wire) or during the appliance assembly. In both cases, as the appliance is being assembled, the component or cover 500 is mated onto the connector housing 505 via fastening mechanism and can for example be snapped onto the connector housing 505. Alternatively, the component 500 can also be co-molded on the connector housing 505, only during the appliance assembly.

The components 100, 300, 400, 500 according to the above-described embodiments can be used to meet the standards for consumer appliances, such as a dishwasher, and should prevent the surrounding parts from catching fire.

The above mentioned embodiments are intended to be illustrative and not restrictive. For example, as discussed for FIGS. 2 and 3, at least one of the plates 101, 102 can be bigger than the surface of the connector housing 105 that will be covered. For example, many modifications may be made to the above embodiments by those skilled in the art, and various features described in different embodiments may be freely combined with each other without conflicting in configuration. The principles of the present invention can also be extended to existing other RAST products, and advantageously applied to other types of housings.

What is claimed is:

1. A connector component for a connector, comprising:

a plurality of plates including a first plate and a second plate; and a pair of fastening devices each connected to only one of the first plate and the second plate and freely protruding from the one of the first plate and the second plate in a cantilevered manner to a free end and securing the plates to a connector housing, the plates and the fastening devices are made of a metal or plastic material having a higher inflammability resistance than the connector housing and are adapted to extend on more than one of a plurality of external surfaces of the connector housing.

2. The connector component of claim 1, wherein the first plate and the second plate each have a rectangular shape.

3. The connector component of claim 1, wherein the first plate and the second plate are joined perpendicularly to each other in an L-shape.

4. The connector component of claim 1, wherein the fastening devices freely extend from a pair of opposite edges of the second plate and are each an L-shaped element.

5. The connector component of claim 4, wherein a first part of the L-shaped element is oriented in a direction perpendicular to the second plate and a second part of the L-shaped element is oriented toward an inside of the second plate.

6. The connector component of claim 1, wherein the fastening devices extend from a pair of opposite edges of the first plate in a direction parallel to the second plate and are each a fastening plate, the fastening devices are each tilted toward an inside of the first plate.

7. The connector component of claim 6, wherein the fastening devices each have a hooking portion at an end oriented toward an outside of the second plate.

8. The connector component of claim 1, wherein the fastening devices freely extend from a pair of opposite edges of the one of the first plate and the second plate and are each a rectangular element, the fastening devices are parallel to each other and perpendicular to the one of the first plate and the second plate.

9. The connector component of claim 8, wherein the fastening devices are larger than at least one of the first plate and the second plate and each have a U-shaped end portion.

10. The connector component of claim 8, wherein the fastening devices are smaller than at least one of the first plate and the second plate.

11. The connector component of claim 1, wherein the fastening devices are latches.

12. The connector component of claim 1, wherein the connector component is made of a high thermal resistance polymer.

13. The connector component of claim 1, wherein the connector component is made of polyphenylensulfide.

14. A connector product, comprising:

a connector housing having a plurality of external surfaces; and a connector component reducing a heat dissipation and flame propagation within an appliance in which the connector product is fitted, the connector component including a plurality of plates including a first plate and a second plate and a pair of fastening devices each connected to only one of the first plate and the second plate and freely protruding from the one of the first plate and the second plate in a cantilevered manner to a free end, the fastening devices securing the plates to the connector housing, the plates and the fastening devices are made of a metal or plastic material having a higher inflammability resistance than the connector housing and are adapted to extend on more than one of the plurality of external surfaces of the connector housing.

15. The connector product of claim 14, further comprising a cavity for receiving an electric wire and an insertion slot perpendicular to the cavity for receiving a metallic contact.

16. The connector product of claim 14, wherein the connector product is a power connector.

17. A household appliance, comprising:

a connector component reducing a heat dissipation and flame propagation within the household appliance, the connector component including a plurality of plates including a first plate and a second plate and a pair of fastening devices each connected to only one of the first plate and the second plate and freely protruding from the one of the first plate and the second plate in a cantilevered manner to a free end, the fastening devices securing the plates to a connector housing, the plates and the fastening devices are made of a metal or plastic material having a higher inflammability resistance than the connector housing and are adapted to extend on more than one of a plurality of external surfaces of the connector housing.

18. A method of assembling a connector product, comprising:

molding a connector housing;

inserting a metallic contact;

inserting an electric wire; and fastening a connector component on the connector housing before or after inserting the metallic contact, or before or after inserting the electric wire, the connector component including a plurality of plates including a first plate and a second plate and a pair of fastening devices each connected to only one of the first plate and the second plate and freely protruding from the one of the first plate and the second plate in a cantilevered manner to a free end, the fastening devices securing the plates to the connector housing, the plates and the fastening devices are made of a metal or plastic material having a higher inflammability resistance than the connector housing and are adapted to extend on more than one of a plurality of external surfaces of the connector housing.

19. The method of claim 18, wherein the connector component is latched on the connector housing.

* * * * *